US005516046A

United States Patent [19]

Cline et al.

[11] Patent Number: 5,516,046

[45] Date of Patent: May 14, 1996

[54] EXTENDED WEAR LIFE LOW PRESSURE DROP RIGHT ANGLE MULTI-EXIT ORIFICE DUAL-FLUID ATOMIZER WITH REPLACEABLE WEAR MATERIALS

[75] Inventors: John R. Cline, Akron; Ralph T. Bailey, Uniontown; Bradley W. Kissel, Gallipolis; Robert B. Myers, Norton; Randy J. Reynolds, Canton, all of Ohio

[73] Assignee: The Babcock & Wilcox Company, New Orleans, La.

[21] Appl. No.: 271,293

[22] Filed: Jul. 6, 1994

[51] Int. Cl.[6] ..... B05B 7/04; B05B 1/14

[52] U.S. Cl. ..... 239/427; 239/432; 239/548; 239/591

[58] Field of Search ..... 239/591, 432, 239/499, 429, 427, 433, 548, 567, 423; 451/102, 98

[56] References Cited

U.S. PATENT DOCUMENTS

| | | | |
|---|---|---|---|
| 748,862 | 1/1904 | Hammel | 239/501 X |
| 1,164,389 | 12/1915 | O'Brien | 451/102 |
| 1,474,677 | 11/1923 | Krause | 239/417.3 |
| 2,585,004 | 2/1952 | Gillespie et al. | 239/591 X |
| 4,528,782 | 7/1985 | Bean | 239/591 X |
| 4,679,733 | 7/1987 | Lipp | 239/432 |
| 4,817,342 | 4/1989 | Martin | 451/102 X |
| 4,819,878 | 4/1989 | Bailey et al. | 239/427 |
| 5,129,583 | 7/1992 | Bailey et al. | 239/427 |

FOREIGN PATENT DOCUMENTS

| | | | |
|---|---|---|---|
| 3602921 | 8/1987 | Germany | 239/591 |
| 103871 | 4/1992 | Japan | 239/591 |

OTHER PUBLICATIONS

B & W Proposal No. P12–0318, dated Jul. 8, 1993 offer for sale.

U.S. application Ser. No. 08/271,336 filed Jul. 6, 1994 titled "Extended Wear Life Low Pressure Drop Right Angle Single Exit Orifice Dual Fluid Atomizer with Replaceable Wear Materials," Case 5528.

*Primary Examiner*—Kevin P. Weldon

*Attorney, Agent, or Firm*—Daniel S. Kalka; Robert J. Edwards

[57] ABSTRACT

A dual-fluid low pressure drop atomizer utilizes extended wear life material and comprises a nozzle head having a chamber therein for receiving a mixture of a first compressible fluid and a second fluid containing solids. The nozzle head also has an orifice therein communicating with and adjacent to the mix chamber for discharging jets of the mixture. The orifice and the mix chamber form an approximate right angle therebetween. An inner barrel is connected to the nozzle head at the mix chamber and supplies the first fluid to the nozzle head. An outer barrel is arranged around the inner barrel creating an annulus therebetween and is also connected to the nozzle head for supplying the second fluid to the nozzle head. Wear resistant material provided in the mix chamber reduces erosion within the atomizer head. A plurality of ports are provided in the nozzle head and communicate with the orifice for discharging a jet at a multiplicity of locations.

6 Claims, 2 Drawing Sheets

EXTENDED WEAR LIFE LOW PRESSURE DROP RIGHT ANGLE MULTI-EXIT ORIFICE DUAL-FLUID ATOMIZER WITH REPLACEABLE WEAR MATERIALS

BACKGROUND OF THE INVENTION

1. Field of the Invention

The present invention relates, in general, to atomizers and, in particular, to a new and useful dual-fluid atomizer having a unique multiple exit orifice and replaceable wear materials.

2. Description of the Related Art

Generally, there are many types of atomizers that have been developed in order to atomize a fluid medium into a mist of fine particle size. Most atomizer designs are classified in one of the following categories: 1) hydraulic or mechanical atomizers wherein atomization is accomplished by discharging a fluid at high pressure through an orifice; 2) dynamic atomizers such as a high speed rotary disk or cup; and 3) dual-fluid atomizers in which fluid atomization is achieved by combining a liquid with a compressed gas such as air or steam.

Dual-fluid atomizers are further subdivided into two basic types, depending on the location where the atomizing gas and liquid are mixed, i.e. external to the atomizer or internal to the atomizer. With external mix dual-fluid atomizers, the gas and liquid streams are mixed external to the atomizer housing by impinging one jet against the other. With internal mix dual-fluid atomizers, the atomizing gas and liquid streams are mixed internal to the atomizer and discharged through single or multiple exit orifices.

For erosive applications where particle-laden liquids, i.e. slurries, are the atomized fluid, the type of atomizer is limited by practical constraints. These constraints include flow capacity, the required size of droplets in the atomized spray (i.e. particle size distribution), the size of internal flow passages, the physical durability of the atomizer components (i.e. service life), the atomizers sensitivity with respect to the degradation of performance due to dimensional change caused by the corrosive and/or erosive nature of the fluid to be atomized, and commercially acceptable energy requirements to produce the atomized spray.

There are many different internal mix dual-fluid atomizers that have been developed. U.S. Pat. Nos. 4,819,878 and 5,129,583 disclose two types of dual-fluid atomizers which are currently used.

SUMMARY OF THE INVENTION

The present invention is an extended wear life, low pressure drop, right angle, multiple exit orifice dual-fluid atomizer which utilizes replaceable wear materials. The unique arrangement of the present invention includes large size internal flow passages which allow for the passage of grit or other relatively large particles without clogging and at the same time produces fine atomization of the liquid fraction. The present invention also facilitates the use of corrosion/erosion resistant materials which fully line the internal wetted surfaces of the atomizer for extending the useful wear life of the atomizer while simultaneously reducing overall operating and maintenance requirements.

The present invention utilizes a gas such as compressed air or steam as the atomizing medium to produce a homogeneous mixture of finely atomized liquid droplets containing a uniform dispersion of solids. Where a liquid is not utilized, the present invention produces a fine distribution of powder particles.

The various features of novelty which characterize the invention are pointed out with particularity in the claims annexed to and forming a part of this disclosure. For a better understanding of the invention, its operating advantages and specific objects attained by its uses, reference is made to the accompanying drawing and descriptive matter in which preferred embodiments of the invention are illustrated.

DESCRIPTION OF THE PREFERRED EMBODIMENTS

Figure 1:
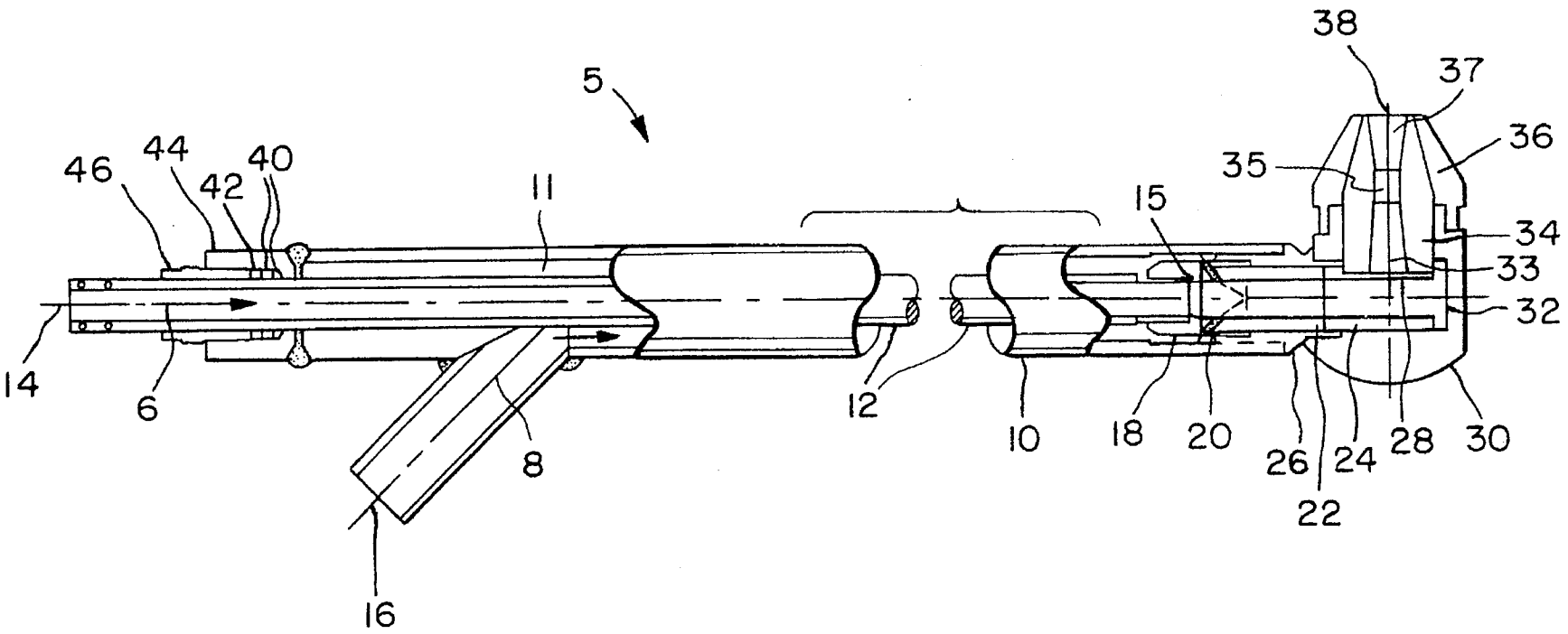
FIG. 1 is a sectional view of a dual-fluid atomizer according to the present invention.

The present invention, as illustrated in FIG. 1, is a dual-fluid atomizer, generally designated 5, comprising an outer barrel 10 having an inner barrel 12 disposed therein and defining an annular space 11 therebetween. The inner barrel 12 has a port or opening 14 at one end for the entry of a slurry, solution, liquid or dry powder flow 6. The outer barrel 10 has an opening 16 for a gas, air or steam flow 8 which flows through annulus 11. The outer barrel 10 and the inner barrel 12 are connected to a mix chamber housing 18 of an atomizer housing 30. The outer barrel 10 and the inner barrel 12 are connected to the chamber housing 18 at their ends opposite openings 16 and 14, respectively. When the present invention is used in a preferred embodiment for atomizing a slurry, chamber housing 18 has an opening 15 which permits the entry of the slurry flow 6 into a primary mix chamber wear sleeve 22 and a secondary mix chamber wear sleeve 24 of the chamber housing 18. Adaptor coupling 26 secures the atomizer housing 30, the mix chamber housing 18 and outer barrel 10.

Inner barrel 12 directs the slurry 6 at low velocities to the inlet of the primary mix chamber wear sleeve 22 where it is initially mixed with atomizing gas 8 provided by outer barrel 10 which enters through gas ports 20 in the primary mix chamber wear sleeve 22.

In the primary mix chamber wear sleeve 22, a three-phase homogeneous mixture of gas, liquid and solid particles flow therethrough and into the secondary mix chamber wear sleeve 24 wherein it impacts a wear plug 32 located at one end of the secondary mix chamber wear sleeve 24 within the atomizer housing 30. Sleeves 22 and 24 and wear plug 32 as well as inserts 34 are made of a wear-resistant material such as ceramic material. The homogeneous mixture is then directed to an inlet 28 of a perpendicular orifice insert 34 in the atomizer housing 30.

Figure 2:
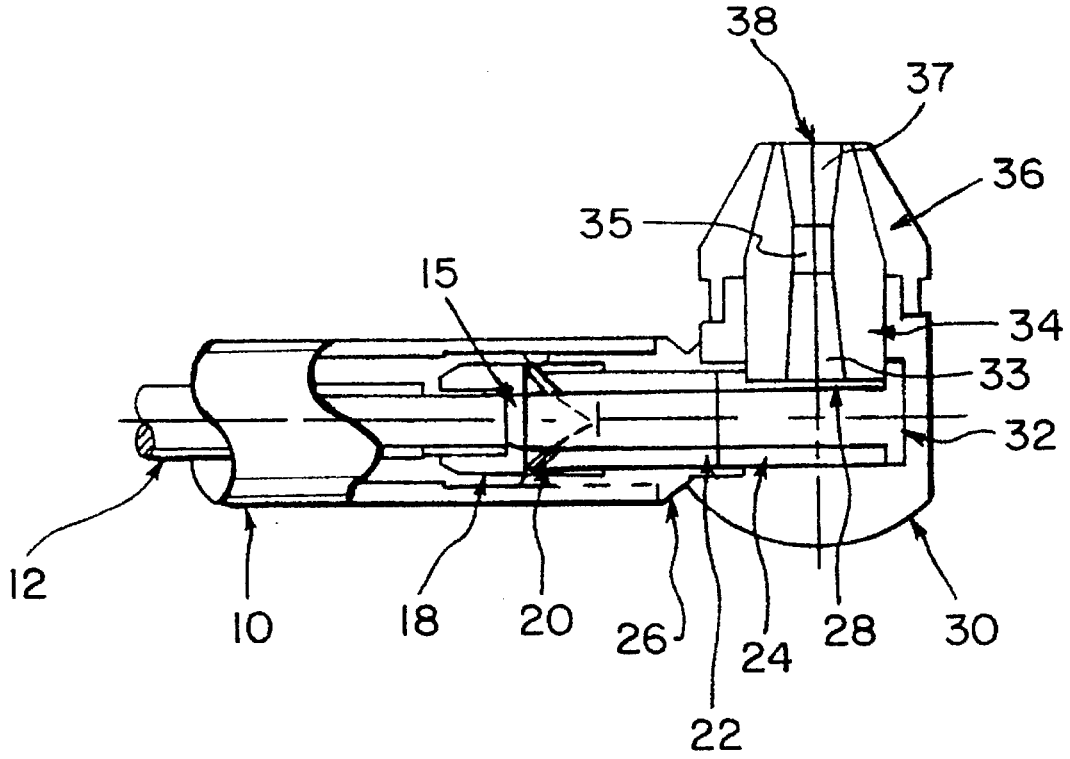
FIG. 2 is an enlarged view of the atomizer head of FIG. 1.

As illustrated in FIG. 2, perpendicular orifice insert 34 has a reservoir 50 at an end opposite the port 28. The three-phase mixture flows through the perpendicular orifice insert 34 and into the reservoir 50 which is a conical-shaped reservoir formed by the perpendicular orifice insert 34 and nozzle assembly 36. At the downstream end of the reservoir 50, a wear pad 52 is located which is also located adjacent orifices 54. The three-phase mixture impacts into the wear pad 52 at the reservoir 50 which results in a further homogenization of the mixture prior to discharge. The homogenized slurry is then discharged through exit orifices 54 in the nozzle assembly 36. The exit orifices 54 located in the assembly 36 communicate with the reservoir 50 for discharging the mixture as an atomized fine mist with a homogeneous distribution of solid particles as it exits through ports 56 located at the end of orifices 54. The exit orifices 54 are holes which are bored through exit orifice inserts 55 which can be made from wear resistant material and preferably touch tangent to each other and are inserted into the nozzle assembly 36 and are maintained in place on the nozzle assembly 36 by a retainer 58. The exit orifice and wear pad inserts can be manufactured in the shape of simple cylindrical and disc shapes. Also, the retainer 58 may have an oversized ID which results in a significant reduction in the accumulation of liquid/slurry deposits on the exterior surface of the nozzle assembly 36.

The atomizer 5 secures the outer barrel 10 to the inner barrel 12 at an end opposite the atomizer housing 30 through the use of packing 40, a follower ring 42, a packing gland 44 and a packing gland nut 46.

The impact of the three-phase mixture of gas, liquid, and solid particles into the surface of the wear plug 32 results in the further break-up of liquid droplets and any agglomerated solid particles therein, ensuring complete homogenization of the three-phase mixture. Immediately following impact into the surface of the wear plug 32, the three-phase mixture turns 90 degrees and exits the secondary mix chamber wear sleeve 24 through port 28 where it is directed into the perpendicular orifice 34 which is located perpendicular to the secondary mix chamber wear sleeve 24. The three-phase mixture enters reservoir 50 at the end of the perpendicular orifice 34, where the liquid phase is further atomized into a fine mist with a homogeneous distribution of solids particles by impacting the mixture against exit wear pad 52 located at reservoir 50.

By utilizing a plurality of exit orifices 54 on the nozzle assembly 36, the present invention permits the discharge of a plurality of jets of three-phase mixture through each port 56 of the exit orifices 54 after collection in the reservoir 50 and contact against the exit wear pad 52. Oversized particles that are contained in the slurry 6, from whatever source, are able to flow through all ports without obstruction. All ports allow for low internal velocities, thereby minimizing both internal pressure losses and erosion. Of course, ports 56 operate at high velocity to produce atomization. The configuration of the atomizer 5 facilitates the use of corrosion/erosion resistant materials, especially for the perpendicular orifice 34 and exit orifices 54 where velocities cannot be held below the threshold of erosion.

The wetted surfaces of the known internal mix dual-fluid atomizers are subjected to an extremely harsh operating environment due to the turbulent conditions created internally beginning at entry point where the atomizing gas and liquid or slurry are first combined together and ending at exit points for discharge. The operating pressure versus flow relationship and atomization performance characteristics of the dual-fluid atomizers are effected by dimensional changes of the internal wetted surfaces. As the wetted surfaces wear, especially the inner diameter of the discharge or exit orifice, atomization quality typically deteriorates to the point where process operations may be adversely effected, thus necessitating atomizer replacement. Furthermore, excessive internal wear may occur to the point of catastrophic atomizer failure.

Until now, the use of corrosion/erosion resistant materials to protect the wetted surfaces of internal mix dual-fluid atomizers for the purpose of extending the useful wear life while simultaneously reducing overall operating and maintenance requirements has been limited by design and/or manufacturing costs/considerations.

The present invention permits the use of replaceable corrosion/erosion resistant wear components manufactured in the form of simple shapes which are used to fully line the internal wetted surfaces of the right angle, multiple exit orifice dual-fluid atomizer 5 in order to extend its useful life while simultaneously reducing overall operating and maintenance requirements.

The manufacture and machining of many corrosion/erosion resistant materials such as certain alloys and ceramics can be very costly. By limiting the configuration of the primary mix chamber wear sleeve 22, secondary mix chamber wear sleeve 24, perpendicular orifice insert 34, wear plug insert 32, wear pad insert 52, and exit orifice inserts 55 to that of simple cylindrical and disc shapes, not only can 100% lining of the internal wetted surfaces from the initial mix point to the point of discharge be achieved but also the difficulty and associated high costs to manufacture these components can be minimized.

The useful service life of the exit orifice insert 55 is significantly increased over that of the known designs through the addition of the straight section 57 located immediately downstream of the inwardly tapering inlet end of the exit orifice insert 55. The major advantage over that of the known designs are improved wear characteristics resulting in an increase in the useful service life of the atomizer 5. With the other configurations, once the minor diameter (i.e. the point where the inwardly tapering inlet and the outwardly tapering outlet begins) of the exit orifice increases in diameter due to the corrosive/erosive nature of the atomized fluid, atomization performance characteristics begin to deteriorate.

For the present invention, the mix chamber inner diameter 13 is sized to maintain the velocity of the three-phase mixture of the atomizing gas, liquid, and solids in the range of 50 to 400 ft./sec. and preferably at a velocity of 200 ft./sec. The inner diameter of the secondary mix chamber wear sleeve discharge port 28 is sized to maintain the velocity of the three-phase mixture of the atomizing gas, liquid, and solids in a range of 150 to 700 ft./sec. and preferably at a velocity of 400 ft./sec.

The mix chamber housing 18 connects two cylinders, i.e. sleeves 22 and 24 open at both ends with atomizing gas ports 20 located around its periphery. The effective length of the mix chamber 13 is defined as the distance between the point at which the centerline of the atomizing gas port 20 intersects the axial centerline of the mix chamber 13 to the point where the centerline of the discharge port 28 intersects perpendicular to the axial centerline of the mix chamber 13. The overall combined effective length of both the primary and secondary mix chamber wear sleeves 22 and 24 may be from 1.0 to 10.0 times the mix chamber internal diameter 13 with the optimum length being within a range of 2.0 to 5.0 times the mix chamber 13 internal diameter.

The atomizing gas inlets 20 into the mix chamber 13 are one or more annulus, or a series of one or more holes, located not more than nine nor less than one mix chamber inner diameter upstream of the centerline of the secondary mix chamber sleeve discharge port 28. The direction of the ports must be greater than 15 degrees and not more than 90 degrees. The size of the ports is adjusted to keep the atomizing gas within the range of 100 to 700 ft./sec. The optimum number of atomizing gas ports 20 is three to four which allows for large passageways to prevent clogging by particles entrained in the atomizing gas, but still maintains balanced mixing of the atomizing gas with the fluid.

The fluid entrance port 15 in the mix chamber housing 18 is located along the axial centerline of the primary and secondary mix chamber wear sleeves 22 and 24 at the end opposite the discharge port 28. The fluid inlet must be a minimum of 0.25 times the mix chamber inner diameter upstream of the atomizing gas inlet ports 20. The size of the fluid inlet port 15 must be such so as to maintain the fluid velocity in the range of 0.5 to 40 ft./sec.

The major diameter of the outwardly tapering discharge of reservoir 50 of the perpendicular orifice insert 34 must be such that it is equal to the diameter of the bolt circle that defines the centerline of the entrance of the exit orifices 54 plus the minor diameter of the exit orifice 54.

The minor diameter of the perpendicular orifice insert 34 is set less than or equal to the inner diameter of the secondary mix chamber discharge port 28 such that the velocity of the three-phase mixture is maintained in the range of 150 to 700 ft./sec.

The height of the outwardly tapering discharge of reservoir 50 of the perpendicular orifice insert 34 must be in the range of 0.1 to 6 of the perpendicular orifice insert 34 inner diameters.

The minor inner diameter of the exit orifices 54 is adjusted to meet capacity requirements. The velocity must be maintained at the critical velocity of the two or three-phase mixture. The diameter and included angle of spray are set to meet design needs.

The inlet radius may be from 2 to 10 times the minor inner diameter of the exit orifice 54. The length of the straight section may be from 0.25 to 5.0 times the minor inner diameter of the exit orifice 54 with the optimum length being in the range of 1.0 to 2.0 times the minor inner diameter.

The included angle of the discharge port 56 must be in the range of 3 to 14 degrees. The inlets of the exit orifices 54 must be positioned in the nozzle assembly 36 such that they are located on a circle centered on the axis of the atomizer housing 30 having a diameter which is equal to or greater than the sum of the perpendicular orifice insert 34 diameter plus the exit orifice minor inner diameter.

Preferably, the outer diameter of the exit orifice inserts 55 must be such that when the exit orifice inserts 55 are installed in the nozzle assembly 36 they are tangential to one another. This works well providing the number of exit orifices 54 is equal to or greater than five.

For applications where the number of exit orifice inserts 55 is less than five, the tangential arrangement of the exit orifice insert 55 becomes either impossible or impractical to achieve. In order to circumvent this problem, a combination of wear shields (not shown) and exit orifice inserts 55, preferably of equal outer diameter, may be installed in the nozzle assembly 36 to achieve the desired tangential arrangement of corrosion/erosion resistant wear materials and line most of the internal wetted surfaces of the nozzle assembly 36.

The outer diameter of the wear pad 52 must be such that when it is installed in the nozzle assembly 36, it is tangential to the outer diameter of the exit orifice inserts 55.

Major advantages for the present invention include the following: the configuration of the present invention permits the co-current or countercurrent injection of an atomized liquid, solution, dry powder, or slurry into a gas stream flowing perpendicular or near perpendicular to the central axis (i.e. center line of the inner/outer barrels) of the atomizer; the configuration of the present invention permits the homogeneous mixing of the gas, liquid and/or solid particles to take place along the central axis (i.e. center line of the inner/outer barrels) of the atomizer before discharging at a right angle with respect to the central axis, thus minimizing the overall profile of the atomizer head; the configuration of the present invention permits the simple replacement of all internal wetted wear components; there is an improved exit orifice insert wear life resulting from lengthening the flow path of the minor diameter, the exterior shape of the exit orifice inserts, primary and secondary mix chamber wear sleeves, wear plug and wear pad are those of simple cylindrical and disc shapes, thus minimizing manufacturing costs; the tangential arrangement of the corrosion/erosion resistant low pressure drop exit orifice and wear pad inserts minimizes the amount of metal substrate (i.e. base end cap material) exposed to the atomized fluid thus extending the useful service life of the atomizer end cap assembly; enlargement of the exit orifice insert retainer inner diameter reduces/eliminates the interference of the retainer inner diameter with the atomized jets resulting in a significant reduction in the accumulation of liquid/slurry deposits on the exterior surface of the nozzle assembly; and the included angle of spray may be varied from 20 degrees to 160 degrees.

While specific embodiments of the invention have been shown and described in detail to illustrate the application of the principles of the invention, it will be understood that the invention may be embodied otherwise without departing from such principles.

What is claimed is:

1. A dual-fluid low pressure loss and reduced deposition atomizer for discharging jets of a first compressible fluid and a second fluid containing solids comprising:

a nozzle head having a secondary mix chamber therein for receiving and mixing an initially mixed mixture of the first fluid and the second fluid from a primary mix chamber, the head having an orifice therein communicating with and adjacent but at an approximate right angle to the secondary mix chamber for passing the mixture to a reservoir at one end of the orifice where the mixture is discharged as jets through a plurality of exit orifices communicating therewith;

first barrel connected to the nozzle head for supplying the first fluid to the nozzle head;

second barrel connected to the nozzle head for supplying the second fluid to the nozzle head; and means for resisting wear in the primary and secondary mix chambers.

2. The atomizer according to claim 1, wherein said means for resisting wear includes a wear pad in the nozzle head near the reservoir.

3. The atomizer according to claim 2, wherein the primary and secondary mix chambers have an overall length from 1.0 to 10.0 times an internal diameter of the mix chambers.

4. The atomizer according to claim 1, further comprising means for resisting wear positioned in each of the exit orifices.

5. The atomizer according to claim 4, further comprising means for resisting wear positioned in the reservoir and the orifice.

6. The atomizer according to claim 3, wherein the primary and secondary mix chambers have a length ranging from 2.0 to 5.0 times the internal diameter.

* * * * *

UNITED STATES PATENT AND TRADEMARK OFFICE

CERTIFICATE OF CORRECTION

PATENT NO. : 5,516,046

DATED : May 14, 1996

INVENTOR(S) : John R. Cline, et al

It is certified that error appears in the above-identified patent and that said Letters Patent is hereby corrected as shown below:

In the drawings Figures 1 and 2 should be deleted to be replaced with the corrected Figures 1 and 2, as shown on the attached pages.

Signed and Sealed this

Twenty-sixth Day of November 1996

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,516,046

DATED : May 14, 1996

INVENTOR(S) : John R. Cline, et al

It is certified that error appears in the above-identified patent and that said Letters Patent are hereby corrected as shown below:

Fig. 1 should be as shown below, to indicate a multi-exit orifice:

FIG. 1

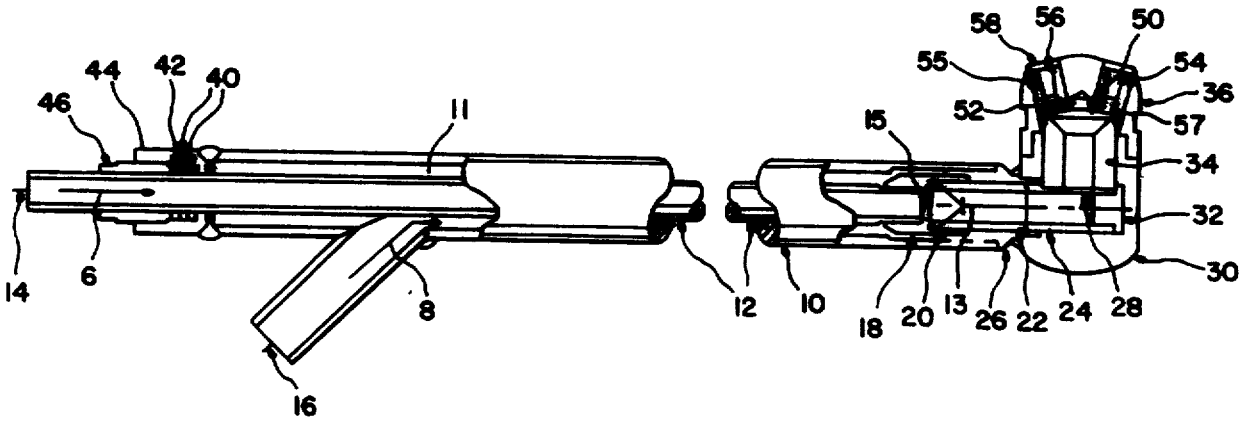

UNITED STATES PATENT AND TRADEMARK OFFICE

CERTIFICATE OF CORRECTION

PATENT NO. : 5,516,046

DATED : May 14, 1996

INVENTOR(S) : John R. Cline, et al

It is certified that error appears in the above-identified patent and that said Letters Patent are hereby corrected as shown below:

Fig. 2 should be shown as below, to indicate a multi-exit orifice;

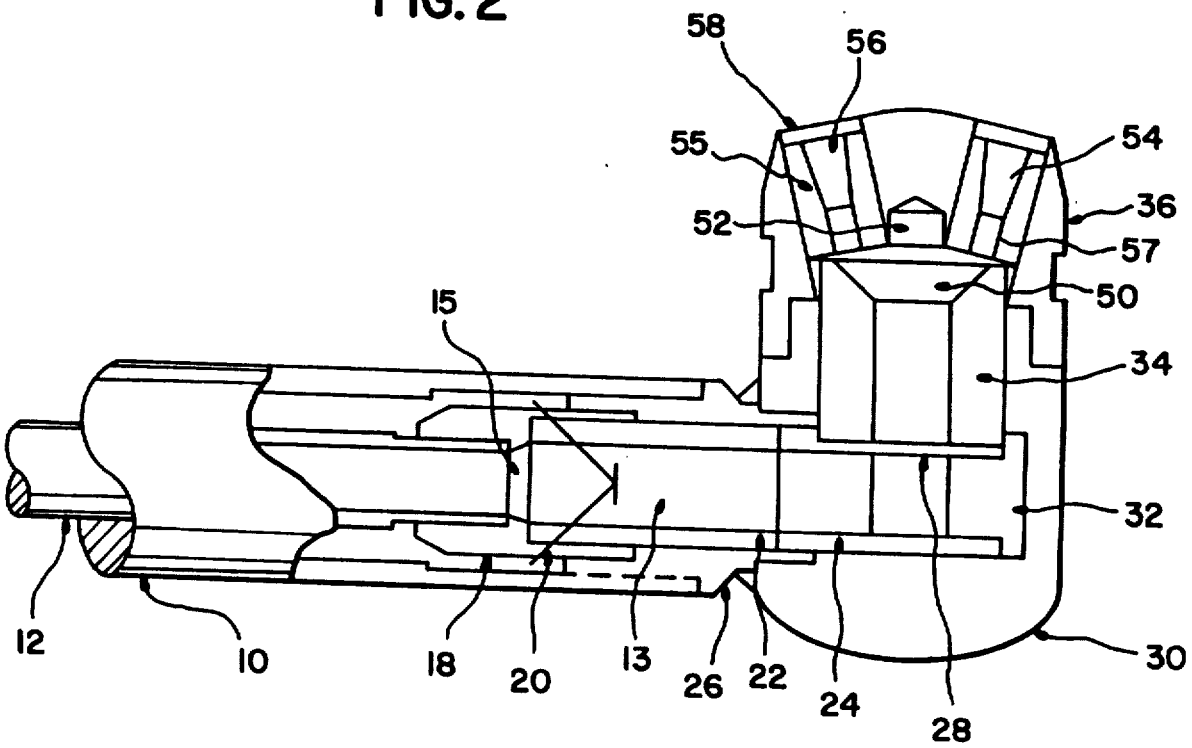

FIG. 2